US007218868B2

(12) United States Patent
Ahn et al.

(10) Patent No.: US 7,218,868 B2
(45) Date of Patent: May 15, 2007

(54) IMAGE FORMING APPARATUS HAVING LOCKING/RELEASING UNIT

(75) Inventors: Byeong-hwa Ahn, Seongnam-si (KR); Se-hyun Lyu, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 170 days.

(21) Appl. No.: 10/896,857

(22) Filed: Jul. 23, 2004

(65) Prior Publication Data

US 2005/0095018 A1 May 5, 2005

(30) Foreign Application Priority Data

Oct. 31, 2003 (KR) ..... 10-2003-0076702

(51) Int. Cl.
*G03G 15/00* (2006.01)
*G03G 15/16* (2006.01)

(52) U.S. Cl. ..... 399/13; 399/113; 399/121

(58) Field of Classification Search ..... 399/13, 399/121, 110, 113; 347/138, 152
See application file for complete search history.

(56) References Cited

U.S. PATENT DOCUMENTS

| | | | | |
|---|---|---|---|---|
| 5,315,359 | A * | 5/1994 | Nishikawa | 399/323 |
| 5,587,769 | A * | 12/1996 | Sawada et al. | 399/113 |
| 5,742,319 | A * | 4/1998 | Fukunaga et al. | 399/113 X |
| 5,784,665 | A * | 7/1998 | Bae | 399/13 |
| 5,983,062 | A * | 11/1999 | Sameshima | 399/110 X |
| 6,343,198 | B1 * | 1/2002 | Sato | 399/121 |
| 6,445,895 | B2 * | 9/2002 | Shirasawa et al. | 399/121 X |
| 6,941,094 | B2 * | 9/2005 | Omata et al. | 399/121 |
| 2003/0210925 | A1 * | 11/2003 | Kida | 399/124 |
| 2004/0009008 | A1 * | 1/2004 | Park et al. | 399/121 X |
| 2005/0002687 | A1 * | 1/2005 | Jung et al. | 399/110 |
| 2005/0084290 | A1 * | 4/2005 | Baek et al. | 399/121 |

FOREIGN PATENT DOCUMENTS

| | | | |
|---|---|---|---|
| JP | 02-110579 | | 4/1990 |
| JP | 06-004000 | | 1/1994 |
| JP | 11-296017 | | 10/1999 |
| JP | 2000-187400 | A * | 7/2000 |
| JP | 2001-331080 | | 11/2001 |
| JP | 2002-323833 | A * | 11/2002 |
| JP | 2004-046185 | A * | 2/2004 |
| KR | 01-44747 | | 7/1998 |
| KR | 01-32559 | | 11/1998 |

OTHER PUBLICATIONS

Korean Official Action issued on Aug. 25, 2005, for Korean Patent Application No. 2003-76702 (listing 2 references).

* cited by examiner

*Primary Examiner*—Sophia S. Chen
(74) *Attorney, Agent, or Firm*—Stanzione & Kim, LLP

(57) ABSTRACT

An image forming apparatus including a main body, a photoconductive unit disposed in the main body to develop an image, a transferring unit removably disposed in the main body in contact with the photoconductive unit to transfer the image from the photoconductive unit onto a recording medium, a locking/releasing unit to lock and unlock a mounting position of the transferring unit with respect to the photoconductive unit, and a checking unit to check whether the transferring unit is mounted by the locking/releasing unit. Accordingly, even if the user may inadvertently operate the image forming apparatus while not operating the locking/releasing unit so that the transferring unit and the photoconductive unit are not fixed to each other, the image forming apparatus notifies the user.

36 Claims, 5 Drawing Sheets

IMAGE FORMING APPARATUS HAVING LOCKING/RELEASING UNIT

CROSS-REFERENCE TO RELATED APPLICATIONS

This application claims the priority of Korean Patent Application No. 2003-76702, filed Oct. 31, 2003 in the Korean Intellectual Property Office, the disclosure of which is incorporated herein by reference.

BACKGROUND OF THE INVENTION

1. Field of the Invention

The present invention generally relates to an image forming apparatus, and more specifically, to an image forming apparatus having a checking unit to check whether a transferring unit is mounted therein by a locking/releasing unit.

2. Description of the Related Art

Generally, an image forming apparatus such as a printer or a copier has a photoconductive unit on which an image is formed, a transferring unit to transfer the image from the photoconductive unit onto a paper, and a fixing means to fix at least any one of the photoconductive unit and the transferring unit into the image forming apparatus.

However, a user may inadvertently close a cover of a main body of the image forming apparatus to print an image on a recording medium, such as a paper, while the transferring unit is not completely connected with the photoconductive unit or the image forming apparatus.

At this time, as the transferring unit does not accurately make contact with the photoconductive unit, the image formed on the photoconductive unit is not completely transferred to the transferring unit. Thus, it becomes hard to print a desired image having a high quality.

In addition, as the transferring unit is not completely secured in the image forming apparatus during the operation, troubles may occur to the image forming apparatus and the transferring unit due to the shaking of a transfer belt while rotating and being disposed in the transferring unit.

Accordingly, it is required to provide an image forming apparatus capable of notifying the user that the image forming apparatus is operating while the transferring unit and the photoconductive unit are not secured therein due to the inadvertency of the user.

SUMMARY OF THE INVENTION

An aspect of the present general inventive concept is to provide an image forming apparatus capable of notifying a user whether a transferring unit is properly mounted in a main body of the image forming apparatus.

Additional aspects and advantages of the present general inventive concept will be set forth in part in the description which follows and, in part, will be obvious from the description, or may be learned by practice of the general inventive concept.

The foregoing and/or other aspects of the present general inventive concept are achieved by providing an image forming apparatus that may include a main body, a photoconductive unit disposed in the main body to develop an image, a transferring unit removably disposed in the main body in contact with the photoconductive unit to transfer the image from the photoconductive unit onto a recording medium, a locking/releasing unit to lock and unlock a mounting position of the transferring unit with respect to the photoconductive unit, and a checking unit to check whether the transferring unit is mounted in the main body by the locking/releasing unit.

The checking unit may include a sensor to detect whether the transferring unit is positioned in close contact with the photoconductive unit by a locking operation of the locking/releasing unit, and a controller to receive a signal from the sensor and process the received signal.

The checking unit may be controlled by the controller and may further include a displayer to notify a user of the signal generated in the sensor. Alternatively, the checking unit can be controlled by the controller and may further include an alarming unit to notify a user of the signal generated in the sensor.

The image forming apparatus may further include a shock-absorbing unit disposed between the photoconductive unit and the transferring unit to prevent a shock occurring while the transferring unit is mounted in the main body. The checking unit may be disposed to check whether the transferring unit is in close contact with the photoconductive unit by overcoming an elastic force of the shock-absorbing unit due to the locking/releasing unit. The sensor may be an ON/OFF sensor.

BRIEF DESCRIPTION OF THE DRAWINGS

These and/or other aspects and advantages of the general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
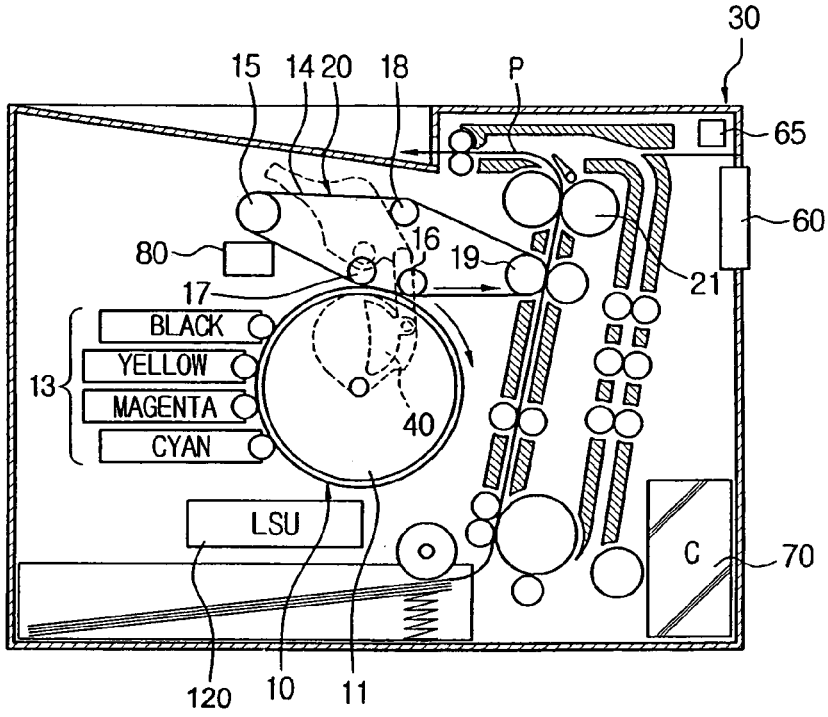
FIG. 1 is a cross-sectional view schematically showing an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the general inventive concept by referring to the figures. FIG. 1 shows the image forming apparatus according to an embodiment of the general inventive concept. A reference P indicates a paper delivery path.

As shown in FIG. 1, the image forming apparatus 30 may include a photoconductive unit 10 having a photoconductive medium (OPC drum) 11, a laser scanning unit 120, a developing device 13, a transferring unit 20 having a transfer belt 14, plural rollers to rotate the transfer belt 14 on an endless track, and a fixing roller 21 to fix an image. The plural rollers may include a transfer roller 16 to transfer the image onto the transfer belt 14, a drive roller 19 to supply a driving force to the transfer belt 14, a tension roller 18 and a nip roller 17 to adjust a tension of the transfer belt 14, and a backup roller 15 to idle according to the rotation of the drive roller 19.

The image forming apparatus 30 sequentially performs procedures such as charging, laser scanning, developing, transferring, and fixing to print a desired image on a paper.

Figure 2:
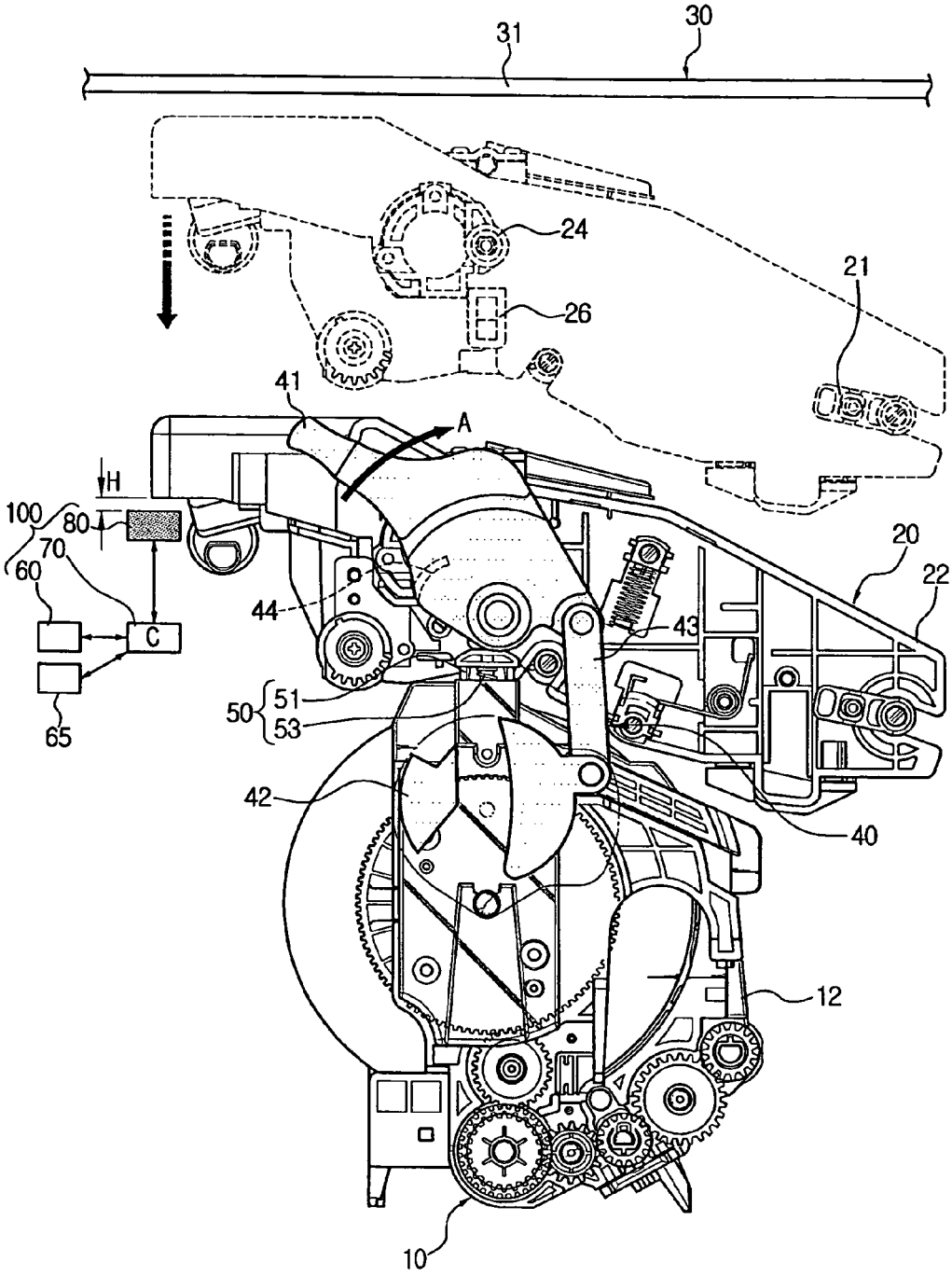
FIG. 2 is a cross-sectional view showing a transferring unit in contact with a photoconductive unit in FIG. 1.
Figure 3:
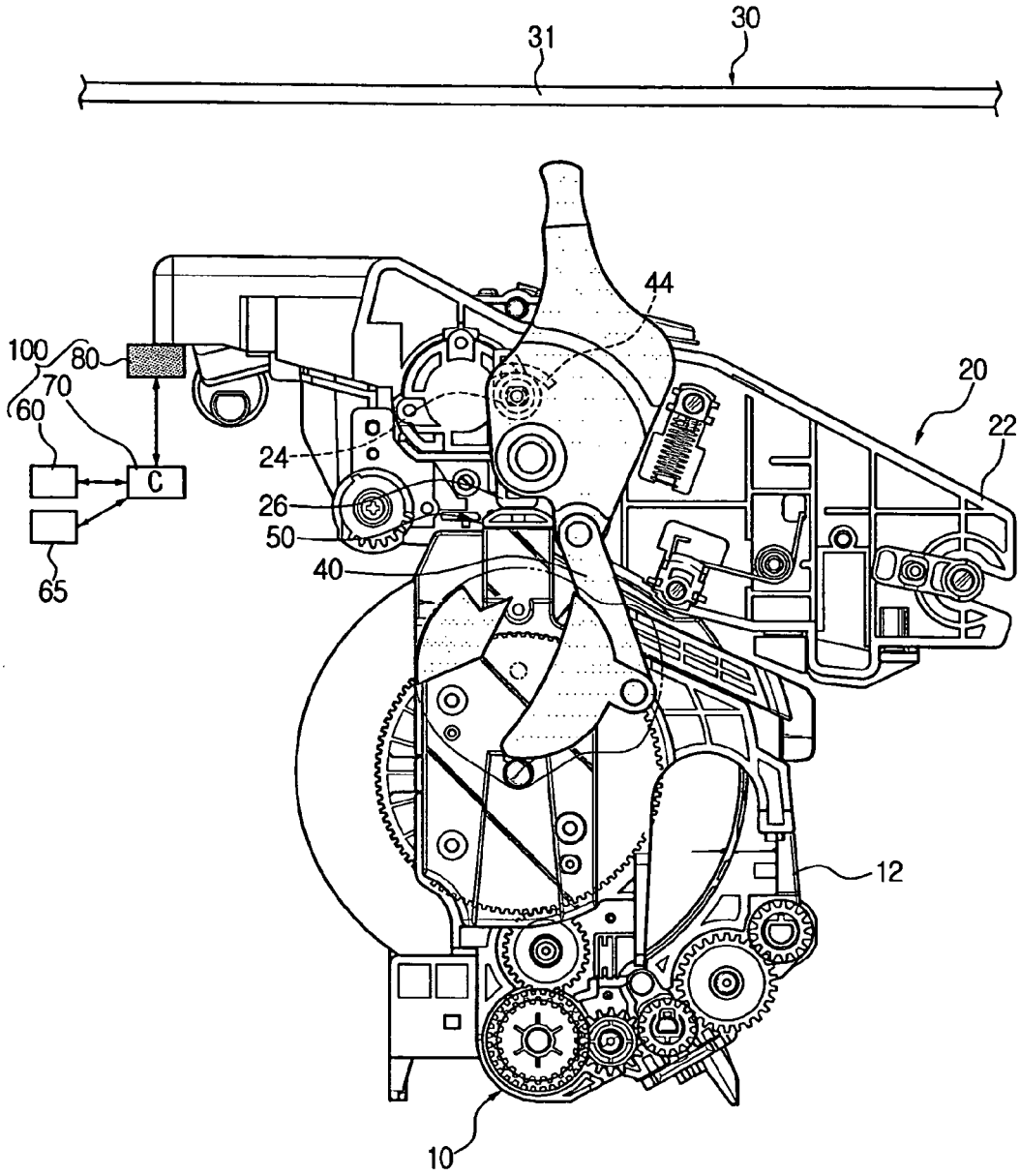
FIG. 3 is a cross-sectional view showing the transferring unit in close contact with the photoconductive unit by a locking/releasing unit in FIG. 1.

Referring to FIGS. 2 and 3, the image forming apparatus 30 can check whether the transferring unit 20 is secured by the locking/releasing unit 40. FIG. 2 shows the transferring unit 20 in contact with the photoconductive unit 10 of FIG. 1. FIG. 3 shows the transferring unit 20 in close contact with the photoconductive unit 10 with the aid of the locking/releasing unit 40 in FIG. 1.

As shown in FIGS. 2 and 3, the image forming apparatus 30 may include the photoconductive unit 10, the transferring unit 20, the locking/releasing unit 40, and a checking unit 100.

The photoconductive unit 10 on which the image is formed may include a photoconductive unit body 12 forming an external appearance of the photoconductive unit 10, and a shock-absorbing unit 50 disposed at a side of the photoconductive unit body 12. The shock-absorbing unit 50 may be disposed between the photoconductive unit 10 and the transferring unit 20 to prevent a shock from occurring when the transferring unit 20 is mounted on the photoconductive unit 10.

The shock-absorbing unit 50 has an absorbing body 51 movably disposed at the photoconductive unit body 12 and an elastic member 53 to provide an elastic force to the absorbing body 51.

The transferring unit 20 is removably disposed in a main body 31 of the image forming apparatus 30 to make contact with the photoconductive unit 10, and transfers the image developed in the photoconductive unit 10 onto a recording medium, such as a paper.

The transferring unit 20 may have a transferring unit body 22 forming an external appearance of the transferring unit 20 and a first and second guide members 21 and 24, respectively, disposed at two sides of the transferring unit body 22 to guide the transferring unit 20 into the image forming apparatus 30. At both sides of the transferring unit body 22 at which the first and second guide members 21 and 24 are disposed, a pressing member 26 is also disposed to press the shock-absorbing unit 50 of the photoconductive unit 10.

In FIG. 2, the shock-absorbing unit 50 is illustrated as being disposed at the photoconductive unit 10 and the pressing member 26 is illustrated as being disposed at the transferring unit 20. However, the shock-absorbing unit 50 may be disposed at the transferring unit 20 while the pressing member 26 is disposed at the photoconductive unit 10, alternatively.

The locking/releasing unit 40 can be disposed at the main body 31 to lock and release the transferring unit 20 to and from the photoconductive unit 10.

The locking/releasing unit 40 can be disposed at both sides of the main body 31 so that two locking releasing units 40 can correspond to each other, and has a rotary lever 41, a rotary cam 42, and a connection bar 43 to interconnect the rotary cam 42 and the rotary lever 41 for an association therebetween.

Figure 4:
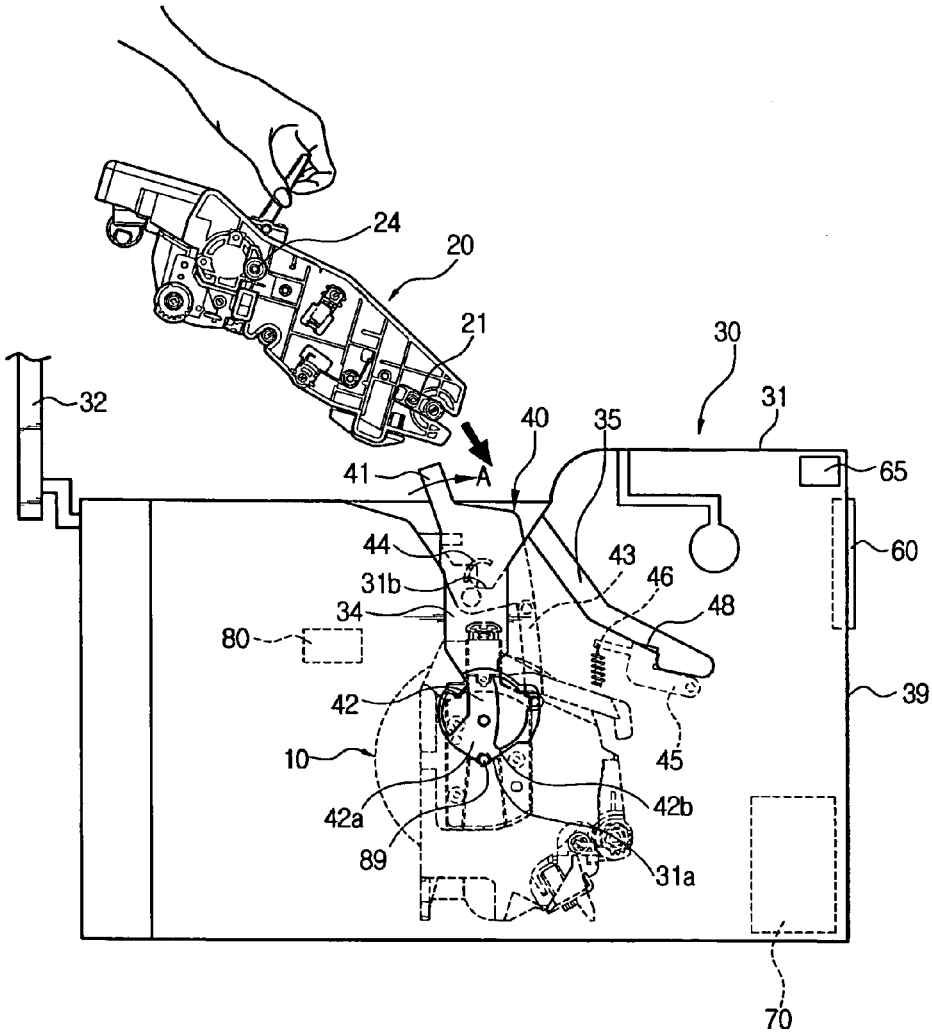
FIG. 4 is a view showing the transferring unit being received in the image forming apparatus by the locking/releasing unit in FIG. 1.
Figure 5:
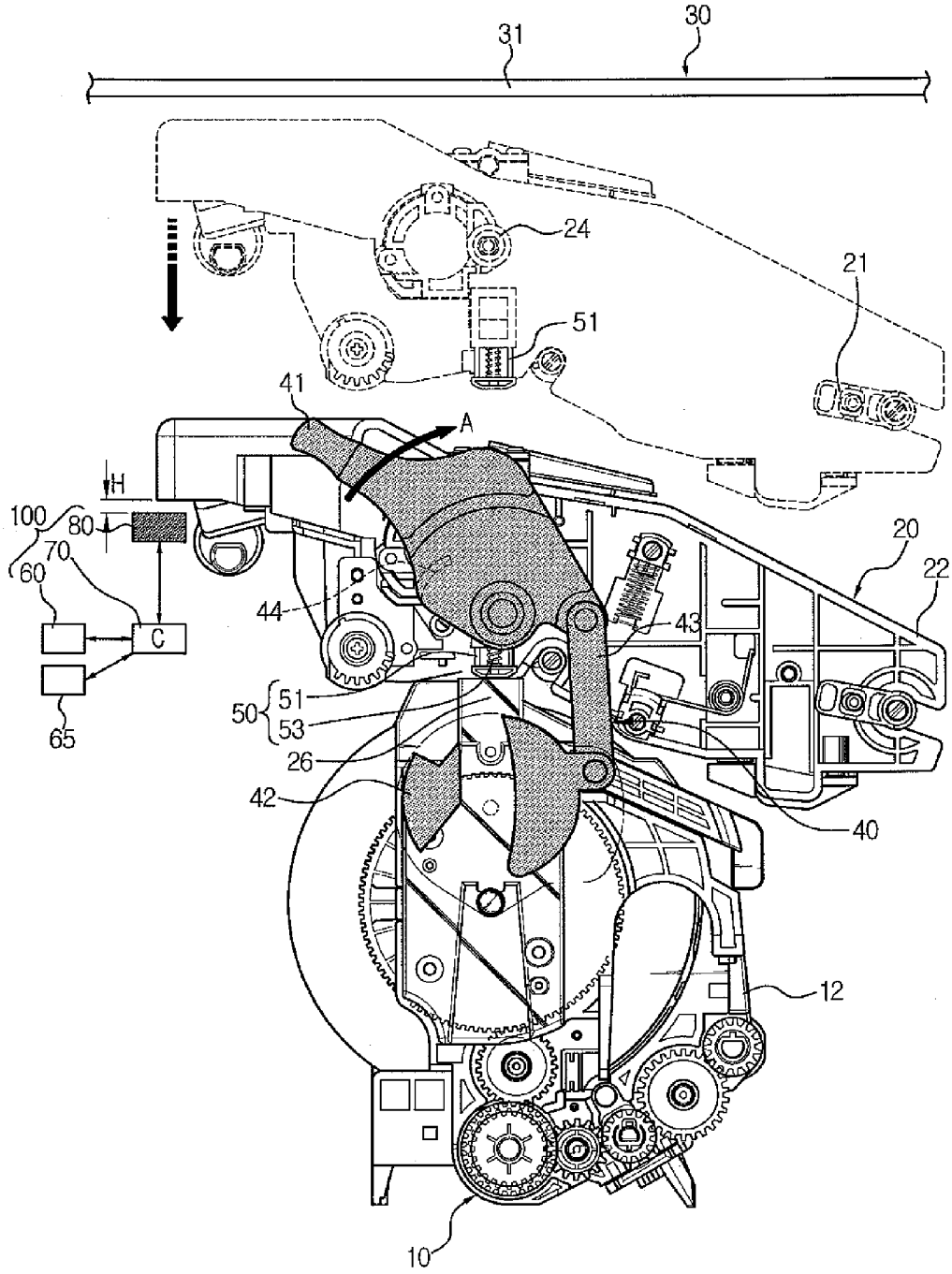
FIG. 5 is a view illustrating a cross-sectional view of an absorbing body disposed on a transferring unit and a pressing member being disposed on a photoconductive unit, according to an embodiment of the present general inventive concept.

Referring to FIG. 4, a user can manually rotate the rotary lever 41. At a side of the rotary lever 41 a covering unit 44 may be formed to securely lock the second guide member 24 of the transferring unit 20 received in an upper receiving unit 31*b* of the main body 31.

The rotary cam 42 may have a rail unit 42*a* to be connected to a second guide rail 34 formed at the main body 31, and a pressing unit 42*b* rotatably disposed at the main body 31 to press and lock a guide member 89 of the photoconductive unit 10 received in a lower receiving unit 31*a* during the rotation.

The checking unit 100 checks whether the transferring unit 20 is mounted on the photoconductive unit 10 by the locking/releasing unit 40 and can include a sensor 80, a controller (C) 70, and a displayer 60 that may be disposed in the image forming apparatus 30.

The sensor 80 can detect whether the transferring unit 20 is in tight contact with the photoconductive unit 10 by the locking operation of the locking/releasing unit 40. Specifically, when received in the main body 31 and in contact with the photoconductive unit 10, the transferring unit 20 is separated from the sensor 80 by a distance H (see FIG. 2).

At this time, by rotating the locking/releasing unit 40 in a direction A, the transferring unit 20 is securely fixed within the main body 31 and to the photoconductive unit 10, and can contact the sensor 80, as shown in FIG. 3.

The sensor 80 may be an ON/OFF sensor. For example, while not contacting the transferring unit 20, the sensor 80 may be turned on, and while contacting the transferring unit 20, the sensor 80 can send an off signal to the controller 70. Also, the sensor 80 may be a photo sensor having an emitting unit and a receiving unit. The sensor 80 checks whether the transferring unit 20 overcomes the elastic force of the shock-absorbing unit 50 by the locking/releasing unit 40 and makes contact with the photoconductive unit 10.

The controller 70 can receive and process a signal from the sensor 80 and can send the processed signal to the displayer 60 and/or an alarming unit 65.

The displayer 60 displays the received signal on a screen, such as, for example, a liquid crystal screen, and the alarming unit 65 can notify the user of the received signal as an audio signal. The controller 70 determines the signal from the sensor 80. If the image forming apparatus 30 is operated while the locking/releasing unit 40 is not operated to secure the transferring unit 20 to the photoconductive unit 10 and the image forming apparatus 30, the controller 70 can send an error or warning message to the displayer 60 and/or the alarming unit 65.

Then, the user can be notified that the transferring unit 20 is not completely mounted in the image forming apparatus 30. To secure the transferring unit 20 to the image forming apparatus 30, the user operates the locking/releasing unit 40 of the image forming apparatus 30.

Referring to FIG. 4, a procedure to mount the transferring unit 20 in the image forming apparatus 30 by the locking/releasing unit 40 is described.

At an upper part of a mounting portion of the main body 31, an entrance is formed to be opened and closed by a door 32. The transferring unit 20 can be exchanged through the entrance opened by the door 32. A frame 39 can be disposed at the mounting portion in the main body 31 and has a first and the second guide rails 35 and 34, respectively. The first guide rail 35 guides the first guide member 21 and the second guide rail 34 guides the second guide member 24 of the transferring unit 20.

The photoconductive unit 10 is described below as already being mounted in the main body 31 of the image forming apparatus 30, and therefore a detailed description thereof is omitted.

With the photoconductive unit 10 being mounted in the main body 31, the transferring unit 20 can be mounted along the first and second guide rails 35 and 34. Then, by rotating the rotary lever 41 of the locking/releasing unit 40, the pressing unit 42*b* of the rotary cam 42 presses down the guide member 89 of the photoconductive unit 10 to lock the photoconductive unit 10. Simultaneously, the covering unit 44 of the rotary lever 41 can cover and lock the second guide member 24 of the transferring unit 20.

The first guide rail 35 can have an auxiliary locking unit to lock the first guide member 21 of the transferring unit 20. The auxiliary locking unit can include an interference lever 45 rotatably disposed at the frame 39 and a spring 46 to elastically bias a free end 48 of the interference lever 45 to protrude toward the first guide rail 35.

The free end 48 of the interference lever 45 can have a sloped surface and a stepped surface. Due to the sloped surface, the first guide member 21 can smoothly slide downward along the first guide rail 35. Also, the first guide rail 35 is obstructed by the stepped surface while sliding upward along the first guide rail 35.

In the above construction, to mount the transferring unit 20 into the main body 31 in which the photoconductive unit 10 is being mounted, the first guide member 21 of the transferring unit 20 can slide along the first guide rail 35 and can enter into a mounting position. The first guide member 21 can climb down the free end 48 of the interference lever 45 and be received therein.

After the entrance of the first guide member 21 along the first guide rail 35, the second guide member 24 can enter into the second guide rail 34 and can be received at the upper receiving unit 31*b*. As a result, the transferring unit 20 is completely mounted in the main body 31. Next, the transferring unit 20 can be securely fixed at the main body 31 by the locking operation described above with respect to the locking/releasing unit 40.

As described above, the locking operation can be carried out by rotating the rotary lever 41 of the locking/releasing unit 40. If a user rotates the rotary lever 41 in the direction A (see FIGS. 2 and 4) for the locking operation, the covering unit 44 of the rotary lever 41 can cover and prevent the second guide member 24 of the transferring unit 20 from escaping upward. The pressing unit 42*b* of the rotary cam 42 can lock the guide member 89 to prevent it from moving by pressing the guide member 89 of the photoconductive unit 10 toward the lower receiving unit 31*a*. Accordingly, unless the rotary lever 41 is rotated back to an original position, the transferring unit 20 is securely locked by the locking/releasing unit 40.

While locked in the main body 31 as shown in FIGS. 2 and 3, the transferring unit 20 is in close contact with the sensor 80, and the sensor 80 sends the signal to the controller 70 notifying the controller 70 of this state. Receiving the signal from the sensor 80, the controller 70 can send a checking signal to the displayer 60 and/or the alarming unit 65 to check whether the transferring unit 20 is fixed within the main body 30 so that the user can determine whether the image forming apparatus 30 is operating while the transferring unit 20 is completely mounted therein.

If the image forming apparatus 30 operates while the transferring unit 20 is not completely mounted therein, the displayer 60 can display a warning message or a flickering message and/or the alarming unit 65 can output an audio message to the outside.

According to the present general inventive concept, the image forming apparatus 30 can prevent the image formed on the photoconductive unit 10 from being incompletely transferred to the transferring unit 10 due to the transferring unit 20 not accurately being in contact with the photoconductive unit 10.

Further, malfunctioning of the image forming apparatus 30 and troubles with the transferring unit 10 can be reduced, which may occur when the transferring unit 10 is not completely fixed in the image forming apparatus 30 during operation thereof.

In addition, the image forming apparatus 30 provides convenience to the user by notifying the user that the image forming apparatus 30 is operating while the transferring unit 20 and the photoconductive unit 10 are not properly fixed therein by the locking/releasing unit 40 due to inadvertent installation thereof by the user.

Although a few embodiments of the present general inventive concept have been shown and described, the present general inventive concept is not limited to the disclosed embodiments. Rather, it would be appreciated by those skilled in the art that changes and modifications may be made to the embodiments without departing from the principles and spirit of the general inventive concept, the scope of which is defined by the claims and their equivalents.

What is claimed is:

1. An image forming apparatus comprising:

a main body;

a photoconductive unit disposed in the main body to develop an image;

a transferring unit removably disposed in the main body in contact with the photoconductive unit to transfer the image from the photoconductive unit onto a recording medium;

a locking/releasing unit to lock and unlock a mounting position of the transferring unit with respect to the photoconductive unit;

a checking unit to check whether the transferring unit is mounted by the locking/releasing unit; and at least one shock-absorbing unit disposed between the photoconductive unit and the transferring unit to prevent a shock from occurring while the transferring unit is mounted at the mounting position.

2. The apparatus of claim 1, wherein the checking unit comprises:

a sensor to detect whether the transferring unit is positioned in close contact with the photoconductive unit by a locking operation of the locking/releasing unit; and a controller to receive a signal from the sensor and process the received signal.

3. The apparatus of claim 2, wherein the checking unit is controlled by the controller and further comprises a displayer to notify a user of the signal generated in the sensor.

4. The apparatus of claim 2, wherein the checking unit is controlled by the controller and further comprises an alarming unit to notify a user of the signal generated in the sensor.

5. The apparatus of claim 2, wherein the sensor is an ON/OFF switch.

6. The apparatus of claim 1, wherein the checking unit is disposed to check whether the transferring unit is in close contact with the photoconductive unit by overcoming an elastic force of the shock-absorbing unit due to the locking/releasing unit.

7. The apparatus of claim 6, wherein the shock-absorbing unit comprises:

an absorbing body movably disposed at the photoconductive unit; and an elastic member to provide an elastic force to the absorbing body.

8. The apparatus of claim 7, wherein the shock-absorbing unit is provided at two sides of the photoconductive unit.

9. The apparatus of claim 8, wherein the transferring unit comprises a pressing member disposed at two sides thereof corresponding to the two sides of the photoconductive unit, the two pressing members provided to press the respective shock-absorbing unit provided at the corresponding side of the photoconductive unit.

10. The apparatus of claim 6, wherein the shock-absorbing unit comprises:

an absorbing body movably disposed at the transferring unit; and an elastic member to provide an elastic force to the absorbing body.

11. The apparatus of claim 10, wherein the shock-absorbing unit is provided at two sides of the transferring unit.

12. The apparatus of claim 11, wherein the photoconductive unit comprises a pressing member disposed at two sides thereof corresponding to the two sides of the transferring unit, the two pressing members provided to press the respective shock-absorbing unit provided at the corresponding side of the transferring unit.

13. The apparatus of claim 1, wherein the locking/releasing unit is disposed at both sides of the main body to lock and release the transferring unit to and from the photoconductive unit.

14. The apparatus of claim 13, wherein the locking/releasing unit comprises:

a rotary lever;

a rotary cam; and a connection bar to interconnect the rotary cam and the rotary lever for an association therebetween.

15. The apparatus of claim 1, wherein the transferring unit comprises first and second guide members disposed at first and second sides thereof.

16. The apparatus of claim 15, wherein the main body comprises an upper receiving unit to receive the first and second guide members of the transferring unit.

17. The apparatus of claim 15, wherein the locking/releasing unit comprises:

a rotary lever;

a rotary cam; and a connection bar to interconnect the rotary cam and the rotary lever for an association therebetween.

18. The apparatus of claim 17, wherein the rotary lever comprises a covering unit to securely lock the second guide member of the transferring unit after being received in an upper receiving unit.

19. The apparatus of claim 17, wherein the photoconductive unit comprises a guide member to be received in the main body.

20. The apparatus of claim 19, wherein the rotary cam comprises:

a rail unit that connects to the second guide rail of the main body when the cam is rotated; and a pressing unit rotatably disposed at the main body that presses and locks the guide member of the photoconductive unit when received in the main body when the cam is rotated.

21. The apparatus of claim 15, wherein the main body comprises:

a mounting portion disposed therein to receive the transferring unit; and a frame disposed at the mounting portion and having first and second guide rails to guide the first and second guide members of the transferring unit, respectively, therein.

22. The apparatus of claim 21, wherein the mounting portion comprises a door to open and close the mounting portion.

23. The apparatus of claim 21, wherein the first guide rail comprises an auxiliary locking unit to lock the first guide member of the transferring unit.

24. The apparatus of claim 23, wherein the auxiliary locking unit comprises:

an interference lever rotatably disposed at the frame; and a spring to elastically bias a free end of the interference lever to protrude toward the first guide rail.

25. The apparatus of claim 24, wherein the free end of the interference lever has a sloped surface and a stepped surface such that the first guide member smoothly slides along the first guide rail.

26. The apparatus of claim 1, wherein the locking/releasing unit locks and unlocks the mounting position of the transferring unit with respect to the photoconductive unit while the transferring unit is within the main body.

27. The apparatus of claim 1, wherein the transferring unit is removable from the main body in a substantially vertical direction with respect to the photoconductive unit.

28. A method of mounting a transferring unit in an image forming apparatus, the method comprising:

sliding a photoconductive unit into the image forming apparatus along guide rails;

sliding the transferring unit into the image forming apparatus along the guide rails;

locking the transferring unit into a mounting position in association with the photoconductive unit; and detecting whether the transferring unit is mounted correctly in the mounting position.

29. The method of claim 28, wherein the transferring unit is in contact with the photoconductive unit when in the mounting position.

30. The method of claim 28, wherein the detecting operation further comprises the operation of notifying a user of the detected state of the transferring unit.

31. The method of claim 28, wherein the locking of the transferring unit comprises locking the transferring unit into the mounting position in association with the photoconductive unit while the transferring unit is within the image forming apparatus.

32. The method of claim 28, wherein the sliding of the transferring unit into the image forming apparatus comprises sliding the transferring unit into the image forming apparatus in a substantially vertical direction with respect to the photoconductive unit.

33. An image forming apparatus, comprising:

a main body comprising a guide rail;

a photoconductive unit disposed in the main body on the guide rail to develop an image thereon;

a transfer unit moveable along the guide rail between a first position a predetermined distance away from the photoconductive unit and a second position in contact with the photoconductive unit; and a locking/releasing unit to lock the transfer unit at the second position and to release the transfer unit to the first position.

34. The apparatus of claim 33, wherein the transfer unit is positioned within the main body in the first position and in the second position.

35. An image forming apparatus, comprising:

a main body comprising a guide rail;

a photoconductive unit to contain a developed image, the photoconductive unit being disposed in the main body on the guide rail;

a transfer unit to transfer the developed image from the photoconductive unit to a printing medium, the transfer unit being moveable along the guide rail to contact the photoconductive unit; and a checking unit to determine whether the transfer unit is in contact with the photoconductive unit and to notify a user based on the determination.

36. The image forming apparatus of claim 35, wherein the checking unit notifies the user when it is determined that the image forming apparatus is being operated while the transfer unit is not in contact with the photoconductive unit.

* * * * *